1/29/86 CR 4,566,922

United States Patent [19]

Martinez

[11] Patent Number: 4,566,922

[45] Date of Patent: Jan. 28, 1986

[54] METHOD AND APPARATUS FOR REMOVING DEFECTIVE CORRUGATED BOARD BY SPLICING

[76] Inventor: Manuel T. Martinez, Sancho et Fuerte, 21, Pamplona, Spain

[21] Appl. No.: 687,386

[22] Filed: Dec. 28, 1984

Related U.S. Application Data

[63] Continuation-in-part of Ser. No. 436,788, Oct. 26, 1982, abandoned.

[30] Foreign Application Priority Data

Oct. 28, 1981 [ES] Spain ..... 506652

[51] Int. Cl.[4] ..... B31F 1/24; B31F 5/06; B65H 19/08

[52] U.S. Cl. ..... 156/64; 156/159; 156/266; 156/304.5; 156/353; 156/504; 156/470; 156/505; 156/506; 156/512; 156/518

[58] Field of Search ..... 156/159, 266, 304.5, 156/64, 353, 361, 470, 504, 505, 512, 518, 506; 242/57.1, 59

[56] References Cited

U.S. PATENT DOCUMENTS

| | | | |
|---|---|---|---|
| 2,987,108 | 6/1901 | Kilmartin | 156/504 |
| 3,562,045 | 2/1971 | Hasegawa | 156/159 |
| 3,687,787 | 8/1972 | Grand | 156/512 |
| 3,734,370 | 5/1973 | Shumaker | 242/55.1 |
| 3,854,357 | 12/1974 | Kron | 156/502 |
| 4,288,273 | 9/1981 | Butler et al. | 156/470 |

*Primary Examiner*—Jerome Massie

*Attorney, Agent, or Firm*—Laff, Whitesel, Conte & Saret

[57] ABSTRACT

A splicer is used in a corrugated cardboard production line. The splicer has a pair of pivotal levers having opposing jaws which open and close responsive to a pivoting of the levers. The faces of each of the jaws have a pair of pads for enabling a passage of a web of corrugated cardboard when the jaws are opened and for gripping the web when the jaws are closed. A guillotine blade is positioned between the pairs of jaw pads to grip the web when the jaws are closed. A pair of brake shoes are positioned downstream from the jaws for holding the web while the brake shoes are closed. The jaws, blade, and brake shoes are operated in a sequence wherein (a) the web is gripped by the jaws and held by the brake shoes, (b) the blade cuts the web, (c) the jaws open to release their grip while the brake shoes maintain their hold (d) the jaws close to regrip the web, (e) the blade again cuts the web for a second time, and (f) abutting ends of the web are spliced together while the web is held by the brake shoes and gripped by the jaws. Immediately downstream from the splicer, a store of the web is accumulated before the cutting sequence. This stored web is paid out of the store during the cutting sequence so that downstream production line is not interrupted by the cutting sequence.

8 Claims, 13 Drawing Figures

FIG.5
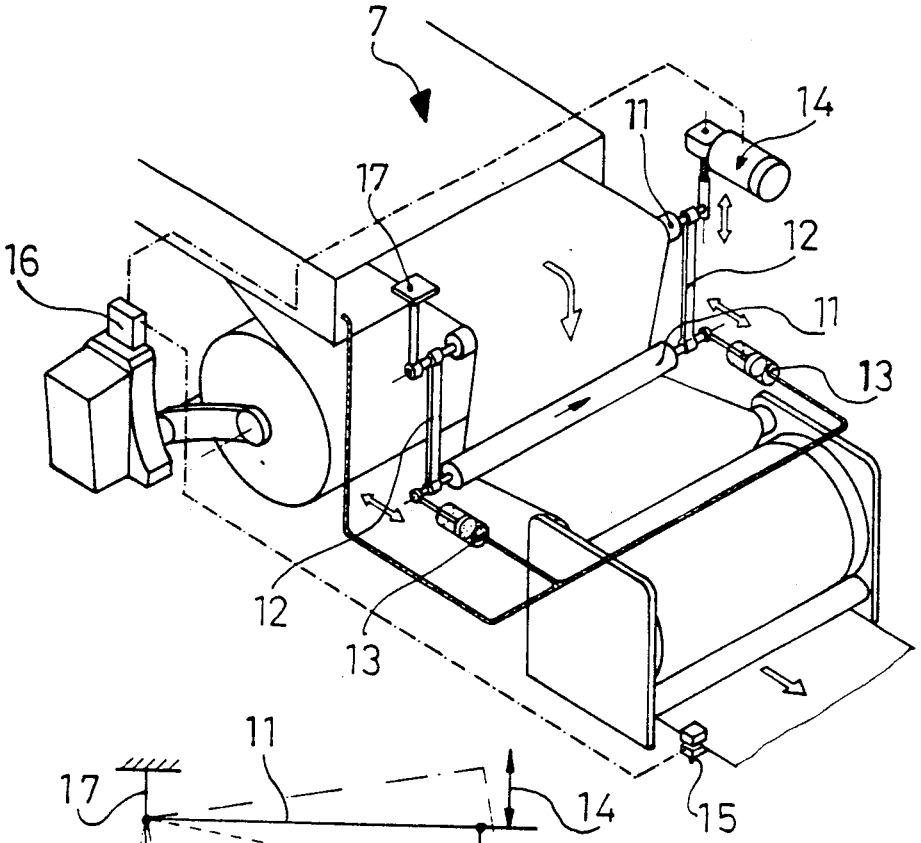
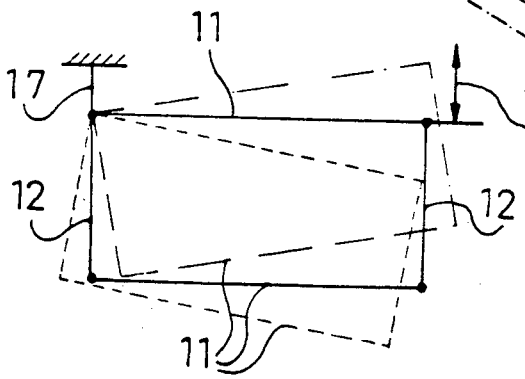
FIG.6

METHOD AND APPARATUS FOR REMOVING DEFECTIVE CORRUGATED BOARD BY SPLICING

This is a continuation-in-part of U.S. patent application Ser. No. 06/436,788, filed Oct. 26, 1982, now abandoned.

This invention relates to corrugated cardboard production systems and, more particularly, to splicers for use in such systems.

At present, the production of corrugated cardboard involves a corrugation of a corresponding sheet of cardboard. Then one of its faces is glued to a smooth sheet of paper. This assembly is then stored on a surface positioned above the level of the rollers and the corrugating mechanism, the surface being called a "bridge". This storage takes place prior to the gluing of a second layer of face paper to the corrugated sheet and to a drying operation, which leaves the cardboard ready for use in subsequent handling machines.

The prior storage on the bridge is necessary in order to compensate possible speed differences which may exist between machinery used in the different processes, including possible interruptions and which may occur in the bridge area. This storage is accomplished through the formation of a series of loops and undulations, which may then be straightened responsive to the pull of the machines which are downstream in the production line.

This conventional system of storing an accumulation of cardboard above the bridge leads to a large number of problems, which include:

(a) There is not a constant tension in the stored cardboard and, with a sudden tension variation, there could be a change from a virtually zero speed in the area of the undulations or loops to the maximum speed of the following machine. This leads to a substantial acceleration where the final loops are stretched out, involving a significant increase in tension.

(b) The rapid increase in the tension is subject to a limit, at which a break of the sheet may result from the acceleration jump. The tension increase occurs at each wave peak consequently limiting the operating speed of the following machines, which have to operate at a reduced efficiency which is less than the maximum possible efficiency in order that the final pull is not so large that it breaks the sheet.

(c) Despite occupying a large area, the bridge stores only a limited amount of cardboard, the quantity not being specifically known since the loops and corrugations form automatically without any size control, which limits an automatic, controlled and interlinked operation between producing elements and a final manufacturing elements.

(d) Due to the tension changes, breaks can occur in the store, which involve long shutdown times and a considerable loss of paper.

(e) The general corrugation of the cardboard over the store bridge leads to deformation of the corrugated paper sheet, which in turn leads to subsequent defects in the finished cardboard. As a result of the configuraton in loop form, the actual corrugations of the cardboard are subject to deformations in the peaks and troughs. As a result, there is a crushing of the cardboard, this being a cause of the aforementioned defects.

(f) The heating elements for drying the glue have a considerable thermal inertia, during shutdown. This inertia lead to unnecessary energy consumption. Also, the cardboard is exposed to excessive reheating and consequently there is an arching of the cardboard. It has not proved possible to solve this problem, linked with the energy consumption, because the high thermal inertia of the heating elements gives rise to the events.

(g) Alignment during storage is brought about by a lateral guide which is a method that is not precise which leads to undesired lateral defects.

(h) In the store located on the bridge, it is virtually impossible to control a defective part or to change the quality in cardboard production or to accommodate any other variable which may occur. When it is absolutely necessary to take action on the bridge store, it must be done manually, with a considerable danger to the operators.

The existence of this "natural" store leads to uncontrolled variables making it impossible to have a completely automated process in which the cardboard would have a correct finish.

In accordance with the present invention, the improvements introduced into the corrugated cardboard production system can be grouped under three main headings:

1. Replacement of the store by a system of displaceable rollers having a controlled spacing, which maintains the existing tension in the cardboard web and providing a storage variation for compensating for speed differences between the processes, thus making it possible at all times to check the quantity of paper stored.
2. Arrangement of the second face layer in an exact alignment prior to the final gluing, which controls the superimposition of both face sheets and prevents edge defects.
3. Arrangement prior to the store of a joining device or splicer in which corresponding joints can be made prior to a possible cut and before entry into the store. This eliminates defects produced in the prior production phase, without entering the defect into storage.

These improvements lead to a more rational adaptation of the system to the requirements of downstream manufacturing machines and provide the following main advantages compared with the prior art:

(a) The existing cardboard tension is always constant, no matter how much capacity exists in the store.

(b) The constant tension permits considerable variation in operating speeds with a maximum efficiency of the complete assembly, and with virtually no possibility of breaking the web while it is in the storage area.

(c) The positioning of pulley rollers in the store can serve as an automatic indicator of an excess or deficiency in the amount of stored material, whereby the indication can serve as a controlled variable for enabling an adjustment of the speeds of the different process machines.

(d) The deformation is prevented which was produced in the folding of the cardboard which occurred in the store prior to eliminating the cardboard loops and corrugations. The cardboard produced is substantially perfect with regards to its corrugation and its edges, thus leading to a total utilization of the paper employed.

(e) The inventive system permits a better storage of the paper over the bridge in the same occupied space, the store being controlled as regards quantity and quality.

(f) It virtually eliminates dead times.

(g) Cardboard is not curved as a result of the reheating, due to the walls, because no walls exist, so that the cardboard is always flat for the continuity of the process.

(h) The heating energy consumption is lower.

(i) There is no need for the staff to get up on to the bridge, thereby obviating the risks of accidents, not only on the bridge, but also as a result of cardboard dropping on to the floor.

(j) These improvements enable the total automation of the process increasing its speed and reducing its defects.

The objects of the present invention relate to certain improvements introduced into the system for the production of corrugated cardboard.

The main advantages indicated hereinbefore, as well as other constructional and functional details which will be described hereinafter lead to the presently proposed system being better than any other systems hitheto known in the art.

The invention is described in greater detail hereinafter relative to non-limitative embodiments and with reference to the attached drawings, wherein shown:

FIG. 5 shows, in perspective, the alignment assembly located at the outlet of the store;

Figure 7:
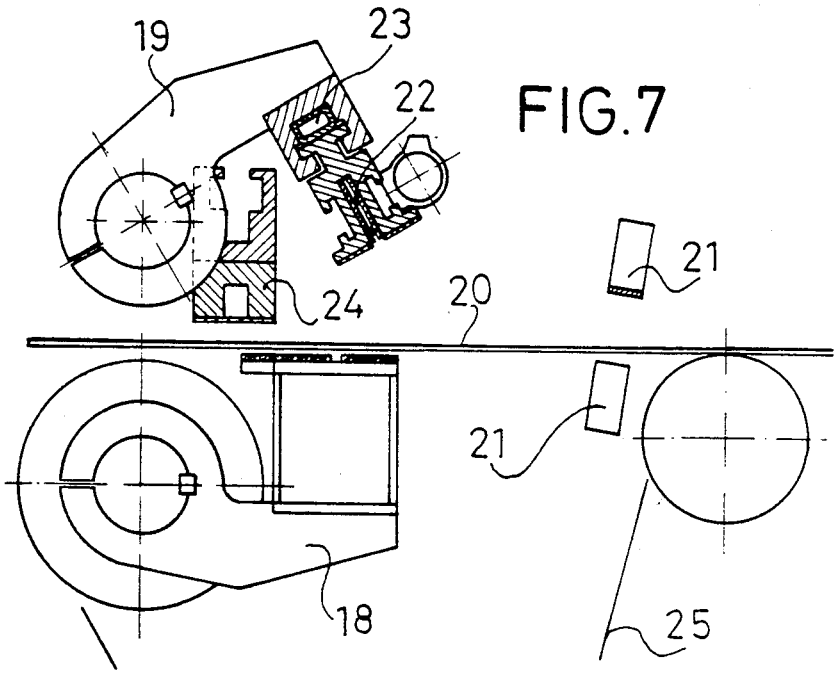
Figure 8:
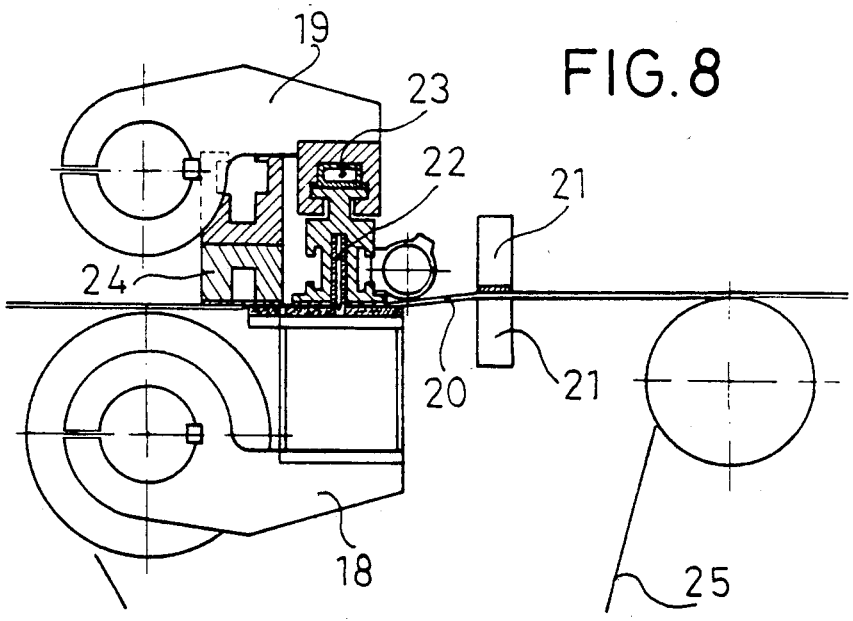
Figure 9:
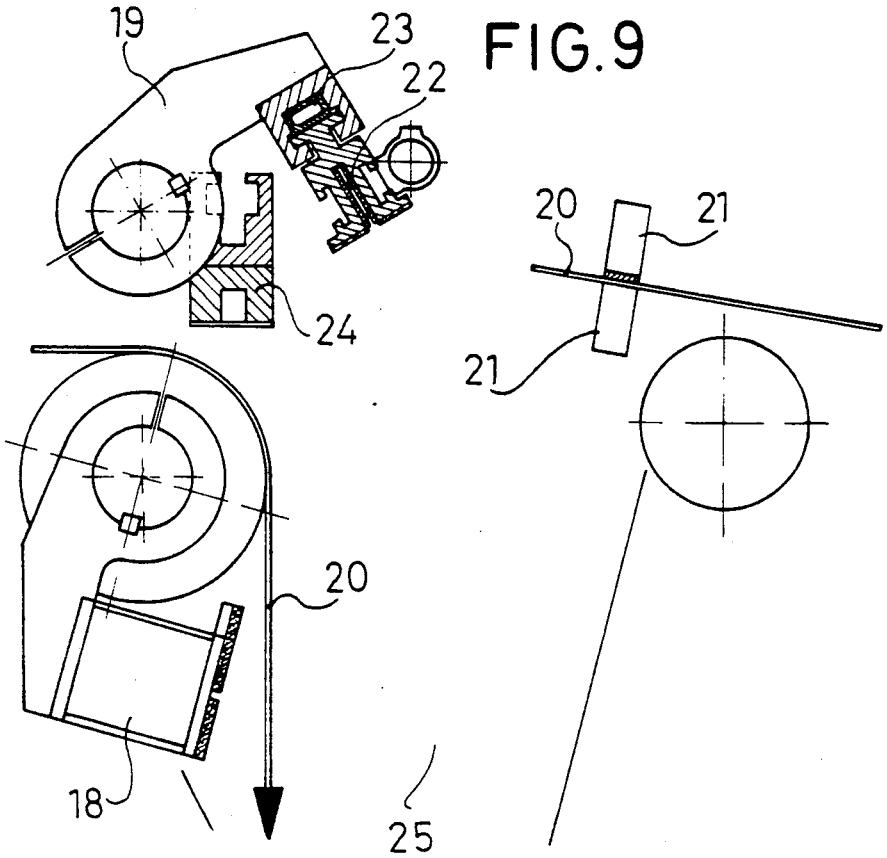
Figure 10:
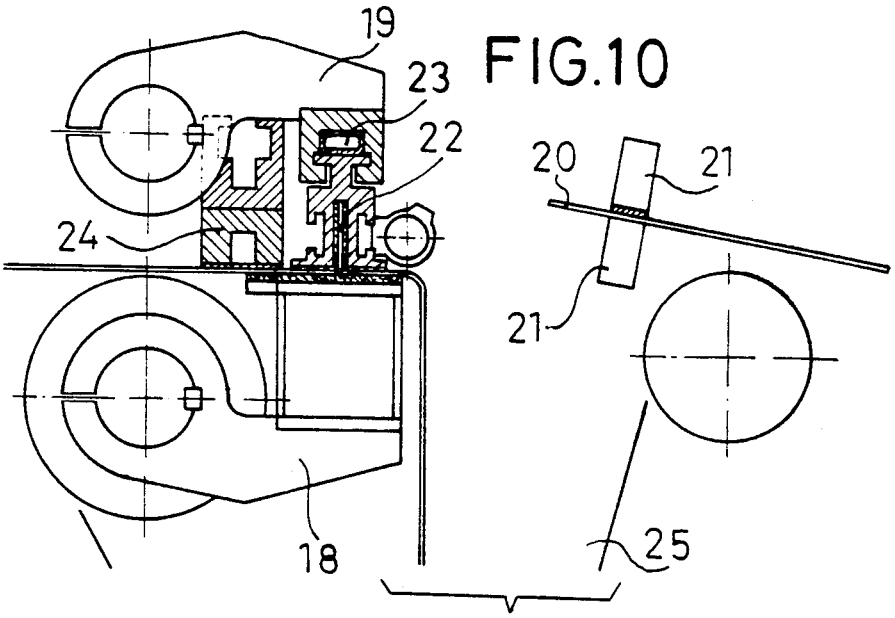
Figure 11:
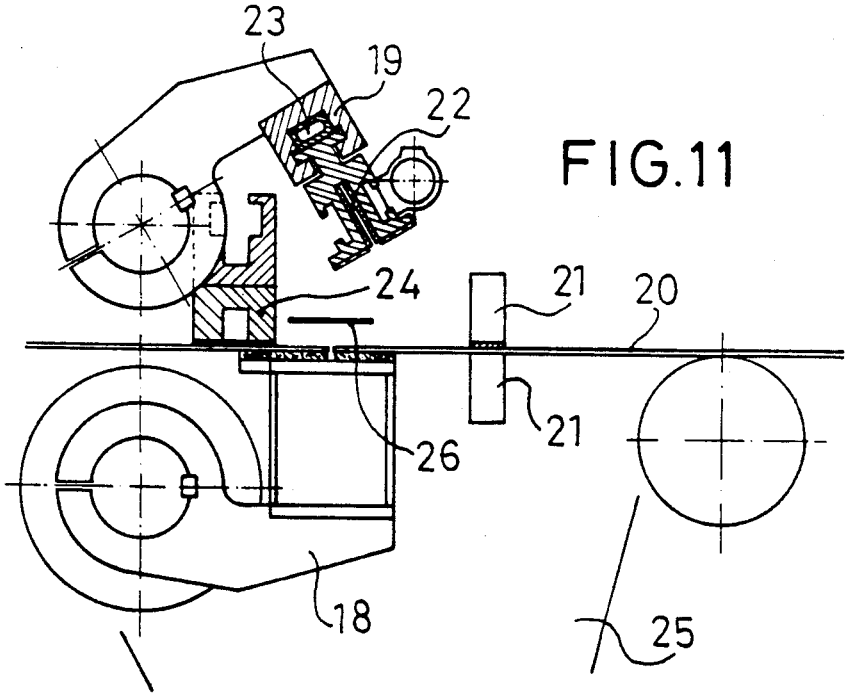
Figure 12:
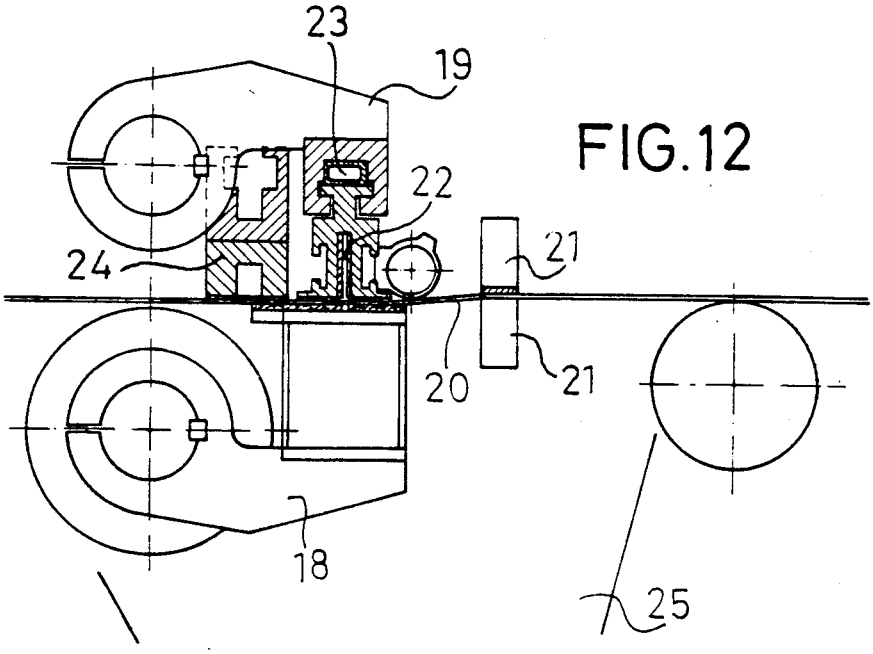
Figure 13:
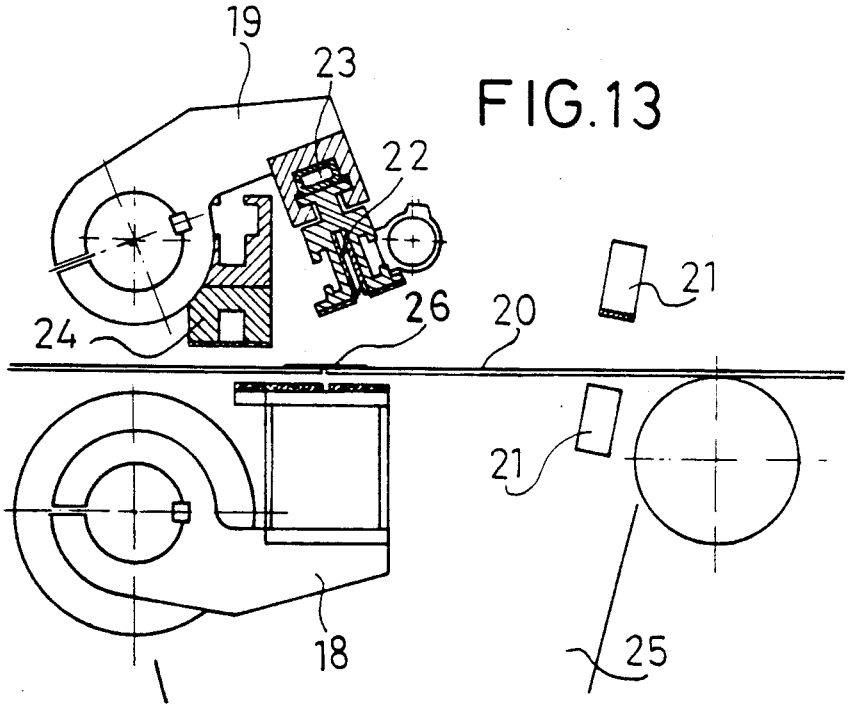

FIG. 6 diagrammatically shows the behavior of the automatic alignment means;

FIGS. 7 through 13 diagrammatically and in elevation show the different actuation stages of the splicer or joining device prior to storage, FIG. 7 showing this device in the rest position;

FIG. 8 shows the first stage representing the braking and the cross-section of the sheet;

FIG. 9 shows the scrapping of the defective sheet;

FIG. 10 shows the final cutting of the defective piece;

FIG. 11 shows the butt to butt positioning of both sheets;

FIG. 12 shows the joining of the end of the store sheet to the beginning of the new sheet; and FIG. 13 finally shows the continuation of the process.

EXPLANATORY DETAILS

The following Table identifies the various parts identified by the reference numbers:

1. Reel
2. Corrugating device
3. Bridge store
4. Reel
5. Gluing machine
6. Constant tension store
7. Automatic alignment device
8. Splicer or Joining device
9.1, 9.2, 9.3, 9.4. Movable rollers
10.1, 102, 10.3, 10.4. Fixed rollers
11. Rollers
12. Connecting rods
13. Support cylinders
14. Actuator
15. Photoelectric cell
16. Control
17. Fixed support
18. Lower arm
19. Upper arm
20. Sheet
21. Brake
22. Cutting tool
23. Pneumatic block
24. Profile
25. Depository
26. Adhesive tape.

Figure 1:
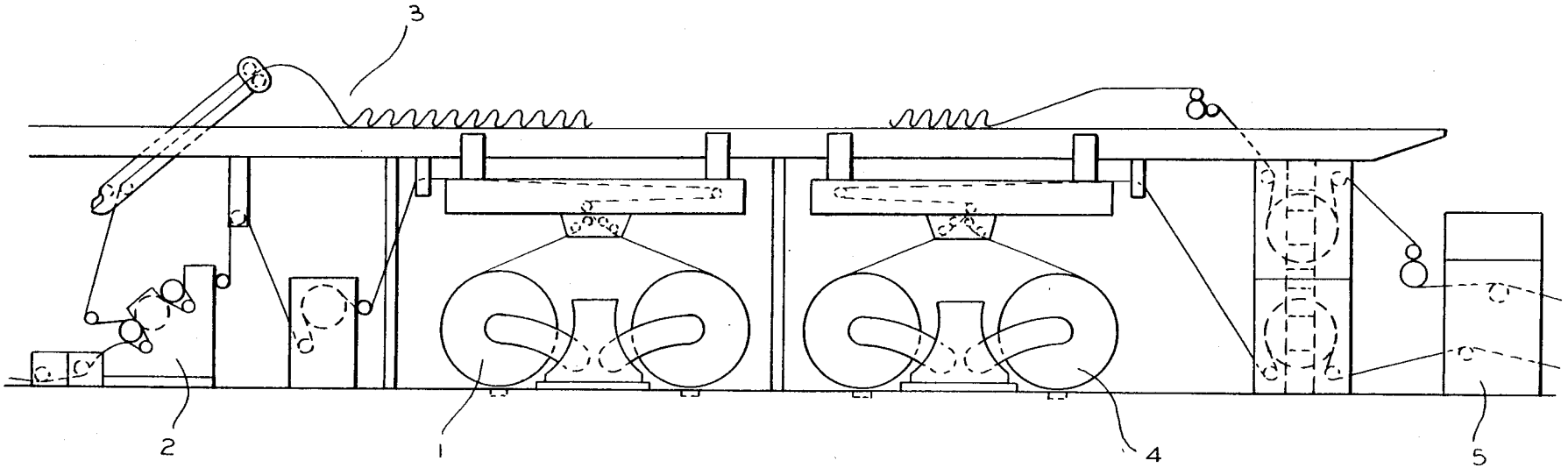
FIG. 1 is a front elevation of the prior art cardboard production system.

FIG. 1 gives a diagrammatic view of the prior art system. According to this system, starting from a reel 1, the paper passes through a corrugating device 2, in which it assumes its characteristic form as a result of a corrugating operation. Then, the paper moves on and one of its faces is glued to a smooth sheet of face paper. The resulting single face corrugated paper is then passed to a bridge store 3, which is positioned above the assembly.

At least theoretically, in this store a compensation takes place with regards to the differences which may exist with respect to the speed and production between the first part of the process and the second part, which follows the store 3. In the second part the cardboard sheet is glued in a gluing machine 5 to a smooth sheet coming from reel 4. Following the drying thereof, it passes to a work station for handling the cardboard.

In the stoage bridge 3, the cardboard is stored in the form of irregular loops and undulations (cf. FIG. 1). It is impossible to know what quantity of cardboard is stored on the bridge, thus preventing any automation of the process. This variation in the stored amount also leads to a variable tension in the web after it leaves the bridge, which causes frequent breaks and deformations in the cardboard, and continual stoppages in the manufacturing process, which are important disadvantages.

Figure 2:
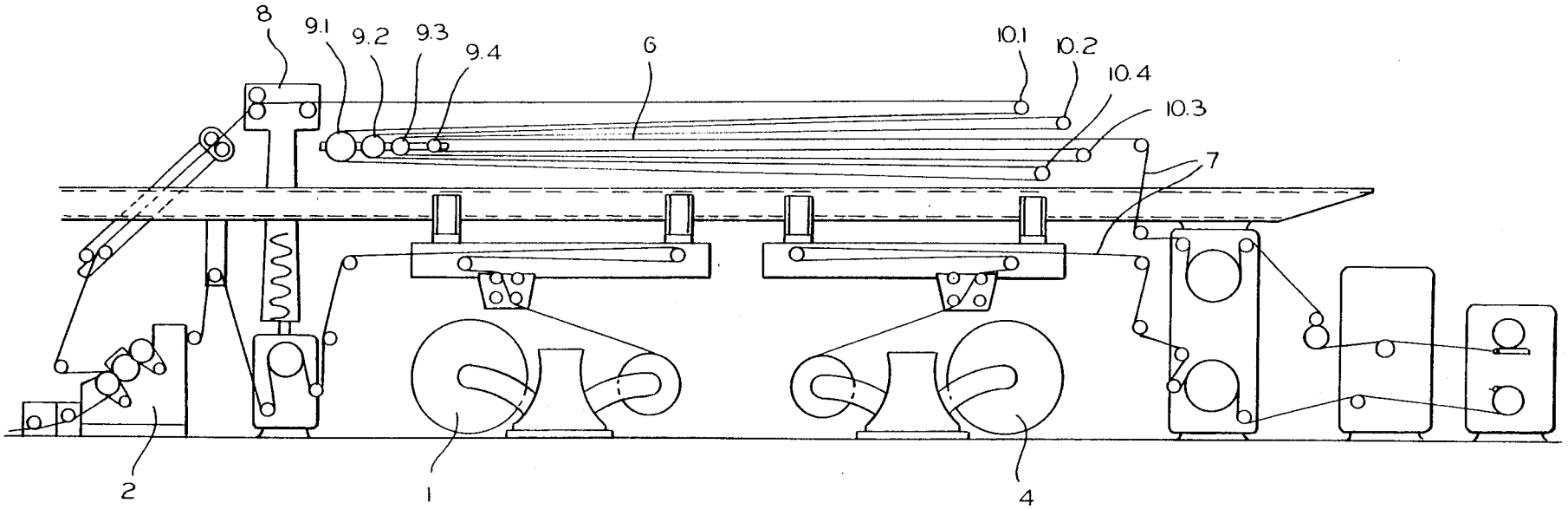
FIG. 2 is a front elevation of a system having the improvements according to the invention, with a detail of the formation of the corrugated paper.

The improvements in the prior art process can be gathered from FIG. 2, according to which the bridge store 3 is replaced by a constant tension accumulator and store 6. In this accumulator, the volume of cardboard is perfectly controlled, the sheet or web is kept perfectly smooth, and the accumulated material has a controlled length. On leaving the accumulator or store 6, both the corrugated sheet and the smooth paper of the second face of layer coming from a reel 4 go through automatic alignment devices 7, respectively. These two webs are pefectly positioned, one moving web above the other, in such a way that there is a prefect matching of their edges when they enter the double gluing machine, thus eliminating any edge defect of the finished cardboard.

In order that the material kept in the accumulator or store 6 may be substantially perfect and without defects, the production cycle can take place in a perfectly satisfactory manner. If there is a break in any part of the web prior to its storage in accumulator 6, a joint or splice can be made without retaining any intermediate defective zone. The splice is made at the entry of accumulator or store 6 and while it is positioned in a joining device or splicer 8. Hence, it is important for the splicer 8 to be on or very near the start of the store, and in front of the accumulator. (cf. FIG. 2) Splicer 8 operates in an automatically controlled manner, at all times. When it is able to scrap any defective part of the web which may have occurred during a first portion of the manufacturing process, i.e. in the corrugating or gluing operations, and before any cut is made in either of the two sheets constitutin in the zone the corrugated cardboard. Also, it is possible to make the subsequent splice or joint for continuing the manufacturing process without interruption.

Figure 3:
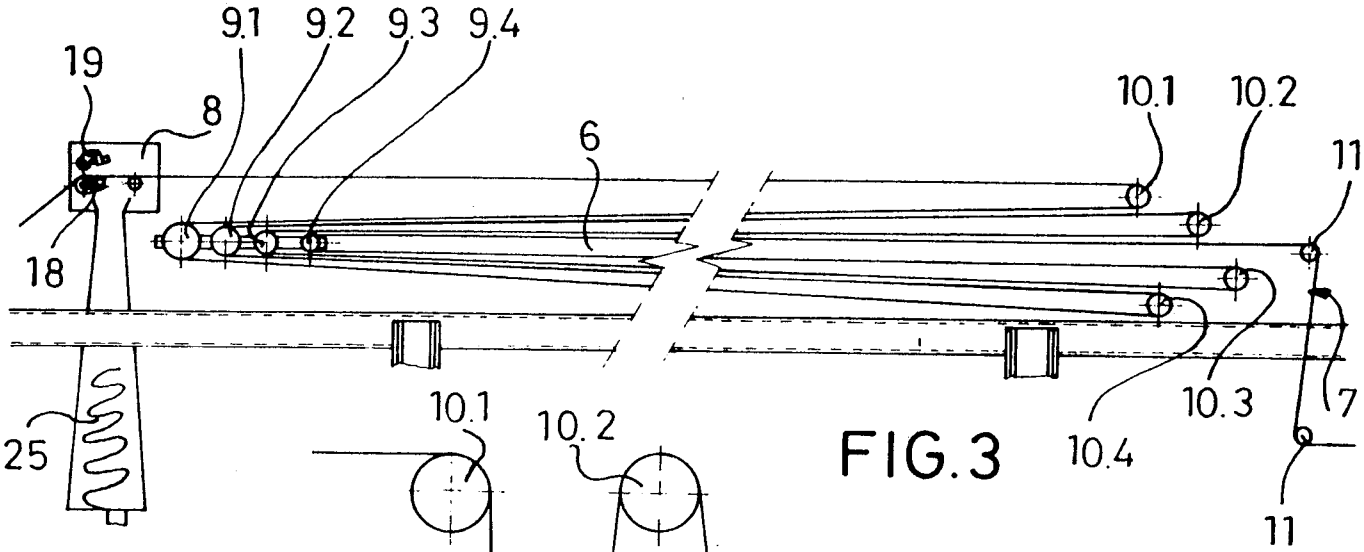
FIG. 3 shows, in greater detail, those parts of FIG. 2 which forms the essential features of the invention.

The constant tension store 6 can be seen best in FIG. 3. A carriage of displaceable rollers 9.1, 9.2, 9.3, 9.4, and a row of fixed rollers 10.1, 10.2, 10.3 and 10.4 are mounted in the bridge region. The positioning of certain of these rollers and the varying diameter of other rollers ensures that the sheet can pass between them, under a constant tension, regardless of the spacing between the carriage and the rollers 9 and the fixed rollers 10. The spacing is maximum in FIGS. 2 and 3 and minimum in FIG. 4.

Figure 4:
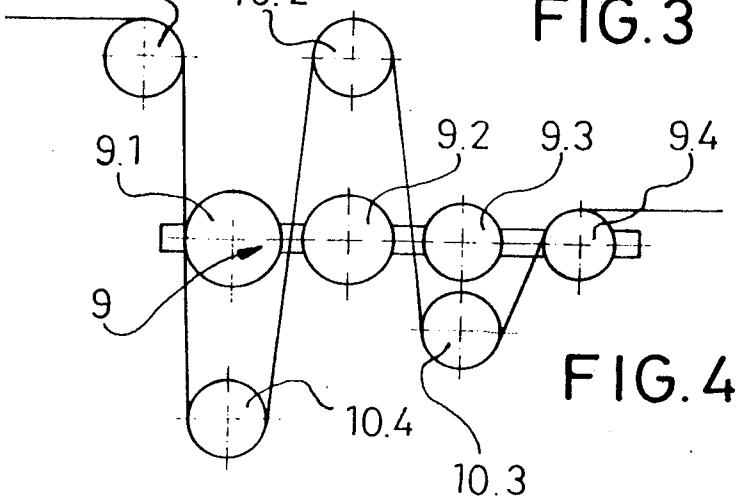
FIG. 4 is a diagrammatic view of the storage rollers in the initial position, in which the cardboard sheet is passed through them.

In the position of FIG. 4, rollers 9 and rollers 10 are disposed in such a way that it is very easy for the corresponding sheet to pass through them. On separation of the carriage of rollers 9, the sheet is raised until it remains in the position shown in FIGS. 2 and 3.

At no time does the displacements of the carriage of rollers 9 alter the constancy of the tension of the sheet. The displacements can also be used, with appropriate detection and actuation means, for carrying out a speed correction between a preceding process and a final process in the production of corrugated cardboard.

A vital element in the production of perfect cardboard requires the two alignment devices 7. Their construction is made very clear in FIG. 5. They essentially comprise a parallelogram linkage formed by two rollers 11, joined in parallel by a plurality of connecting rods. The lower roller 11, and with it the complete parallelogram, is mounted on the ends of a plurality of pistons belonging to both support cylinders 13, which maintain a constant tension as a result of an internal pressure given by a fluid in the cylinder. At the ends of their rods or pistons and in their bearings, both cylinders 13 have a number of rollers which give a certain clearance with respect to the parallelogram. The tension which occurs is always perpendicular to its plane and has no lateral components.

One of the ends of the upper roller 11 is joined, via a hinge joint, to a fixed bearing 17 forming part of the structure of the machine. The other end of upper roller 11 is joined to a vertical worm gear or jack screw which can rise and fall in accordance with the movement given to the worm by an actuator 14 via a reduction gear. The control loop of the device for giving a perfect alignment of the sheet includes a photoelectric cell 15 or a similar device for indicating any deflection or deviation to a control 16, which in turn acts on the actuator 14.

If a large adjustment is required, control 16 primarily establishes a prior adjustment of an axial displacement of the reel supplying the paper sheet. This prior adjustment is completed by the final adjustment carried out by the aforementioned parallelogram linkage which, as a function of the deflection direction, slopes either slightly upwardly or slightly downwardly on connecting actuator 14, as can be seen in FIG. 6. The sheet is brought into its perfectly aligned position. The existence of this automatic alignment device 7 (cf. FIG. 2), both on leaving store 6 and on leaving the reel 4, ensures that in a phase prior to gluing, there is a perfect and accurate superimposing of the sheets. This superimposing assists in maintaining a total utilization of the material employed. In addition, there are neither defects nor deformations produced by the guidance system along the edges of the corrugated cardboard produced.

An indispensable condition for the perfect continuity of the control takes place both in store 6 and in the subsequent production phases. That is, the cardboard enters the store under perfect conditions according to the quality which is desired. This is ensured by the positioning of joining device 8 (FIG. 2) at the entrance to store 6. As a result of an automatic or manual indication of a defect, device 8 cuts one of the two sheets forming the cardboard, stops the entry of material into store 6, scraps the defective part of the sheet, and finally joins the opposite butt, cut ends of the sheet to form a perfect sheet. Thus, the continuity of the process is ensured and machine shutdowns are avoided. This succession of stages in the process of cutting out defective parts and splicing or rejoining opposing butt ends of the corrugated cardboard web can be observed in FIGS. 7 to 13, to be described hereinafter.

In FIG. 7, web or sheet 20 passes between a lower lever arm 18 and an upper lever arm 19, both of which are of a rocking type which pivot about one end (the left end, as viewed in FIGS. 7, 8). Web 20 also passes between two shoes of a brake 21. A defect which occurs prior to an entry of the web into store 6, is detected either by a manual means or by an automatic means. Responsive thereto, the splicer or joining device 8 is actuated. In a first phase, shown in FIG. 8, both arms 18 and 19 pivot around one end and are brought together and joined in a face-to-face contact at their other end, thereby arresting web or sheet 20. Brake 21 closes its shoes against each other to keep the web stationary and prevent its passage and entry into store 6.

A tape advancement member 24 bears on a block or pad of lower arm 18 and also assists in the braking of the web or sheet 20. Member 24 contains a profile for enabling a chain to pass through, while it pulls a tape for joining the butt ends of the cardboard. Immediately on braking, the correct tension is given in upper arm 19 by a pneumatic block 23, web or sheet 20 is cut by an actuation of a cutting tool 22, located in the head of upper arm 19.

As can be gathered from FIG. 9, brake 21 is kept closed and the end of the web or sheet entering the store is secured. Tape advancement or profile member 24 is raised on the separation of arms 18 and 19. As a result of the continuity of the process, web or sheet 20 continues to move and its defective portion passes into a scrap or collecting depository 25, as can best be seen from FIGS. 2 and 3.

After all of the defective portion has dropped into scrap depository 25, an instruction is given so that arms 18 and 19 are held together in a joined position in the manner shown in FIG. 10. Profile member 24 is lowered onto lower arm 18 and consequently contributes to the securing of web or sheet 20. At this moment, the cutting tool 22 is again operated and the defective portion is consequently definitively separated and dropped into depository 25.

In the following stage shown in FIG. 11, upper arm 19 is raised and the end of stored web or sheet 20, still secured by brake 21, is lowered onto the block of lower arm 18. On the lowering of upper arm 19 over the two cut and abutting edges of web 20, at the start and finish of the non-defective parts of web or sheet 20, cf. FIG. 12, the two sheets are joined together by an adhesive tape 26. In the manner shown in FIG. 13, the arms 18 and 19 are then separated, brake 21 opens and profile member 24 rises. The cardboard production continues without interruption.

For the arrangement of adhesive tape 26 in its operating position, a chain carrying a clip or claimp passes through the interior of profile member 24 and of the profile positioned above it. At a given moment and specifically in the splicing phase shown in FIG. 11, the clamp carried by the chain clamps the free end of a roll of adhesive tape 26. When the chain starts moving, it unrolls the adhesive tape 26, positioning it in such a way that on the lowering of the arm 19, tape 26 is cut at its other end. The tape is finally applied to the corresponding abutting ends of the web, i.e. at the start and finish of web or sheet 20.

Adhesive tape 26 is only cut by cutting tool 22 in the operating phase shown in FIG. 12 and is not cut in the other two phases shown in FIGS. 8 and 10 in which the lowering of upper arm 19 contributes to the actuation of cutting tool 22. This is because the actuation of cutting tool 22 cuts the complete web or sheet 20 in the transverse direction, while the cutting of adhesive tape 26 does not need assistance from a supplementary cutting means with respect to adhesive tape 26. The remainder of the adhesive tape is left rolled up for the following cycle.

The actuation of cutting tool 22 is in accordance with the teachings of Spanish Patent No. 484,893. The cutting tool or tools 22 is a guillotine blade which has obliquely set grooves in it and a control or guide bolt which enters each groove. The longitudinal displacement of the bolts in the grooves forces the cutting tool 22 to follow a trajectory which is the same as the oblique line of the grooves, leading to an effective chopping cut, with a minimum travel.

Throughout this joining operation, the corrugation making process has continued without any interruption. The sheet of cardboard is removed from store 6 as rollers 9 move toward rollers 10. In greater detail, the web on sheet 20 threads back and forth between the rollers 9 and 10, e.g. the entering web passes between lever arms 18, 19 of splicer 8 (FIG. 3) and in a successive sequence turns about rollers 10.1, 9.1, 10.4, 9.2, 10.2, 9.3, 10.3, 9.4, and 11. As long as the web is not defective, it continues to travel over this relatively long path so that a substantial amount of cardboard is stored in the bridge area 6.

When a defect is detected, cardboard is pulled from the storage area 6 by causing rollers 9 and 10 to approach each other. By visually comparing FIGS. 3 and 4 it is easily seen that a substantial amount of cardboard may be taken from store 6, all while the web tension is being maintained by holding the rollers under tension and in a separated position. The cutting and splicing sequence shown by FIGS. 7–13 is carried out as the web is paid out of storage. Thus, the corrugated cardboard making equipment which is downstream from splicer 8 continues to operate during the excising of a defective portion and the subsequent splicing of the web, as if there were no interruptions.

As soon as the splicing is complete (See FIG. 13), the rollers 9, 10 begin to move apart to the positions shown in FIG. 3. Thus, the cardboard gradually reaccumulates in store 6. Soon, the original amount of cardboard is in the store 6, ready for the next splicing operation. Thus, the inventive splicer is able to cut a defective section from and rejoin a single web or strip. There is no need to have two webs which may be alternately connected to an output web while the defective part is being cut out of a web that is placed on standby.

As is apparent from the present description, this new system permits the aforementioned advantages, with respect to a correct finish of the cardboard, continuity of the process, elimination of possible breaks in the bridge, saving of material and energy, total control, better working speed, etc., while contributing to automating the process.

This novel corrugated cardboard storage system makes it possible to know at any given time the exact length of the cardboard web that is being held in the store. Consequently the system can be provided with electronic controls, which establish the precise need for unwinding material from the main reels. When it is necessary to change the quality of the product, a maximum utilization is possible. It is known when it is necessary to stop the general supply of cardboard because the length of the stored web or sheet is known.

Although the invention has been described hereinbefore with reference to specific embodiments, it is clear that numerous variants are possible, without passing beyond the scope of the invention.

Those who are skilled in the art will readily perceive how to modify the invention. Therefore, the appended claims are to be construed to cover all equivalent structures which fall within the true scope and spirit of the invention.

The invention claimed is:

1. A process for deleting defective sections in a web of a corrugated cardboard, said process comprising the steps of:

(a) accumulating a store of said web on a bridge of a corrugated cardboard production line, at least some portion of said production line being downstream with respect to said bridge;

(b) detecting a defective section in said web at a location upstream in said production line with respect to said bridge;

(c) closing two pairs of opposing jaws longitudinally displaced along said web at an input end of said bridge where said cardboard is accumulated in step (a), an upstream one of said pairs of jaws having a splicer with web holding and cutting capabilities associated therewith and a downstream set of said jaws having web holding brake means associated therewith;

(d) transversely cutting said web by said splicer at the start of a defective section and while said brake means hold the downstream cut end of said web;

(e) diverting the defective section of said web into a scrap storage area;

(f) transversely cutting the web by said splicer at the end of the defective section of said web;

(g) abutting and splicing together the upstream cut end of said web being held on said splicer jaws and the downstream cut end of said web being held in said brake means; and (h) drawing said web from the storage accumulated in step (a) to maintain the operation of said portion of said downstream production line during steps (c) through (g) of said process.

2. The process of claim 1 wherein said splicer comprises two lever arms each having one end pivotally mounted on opposite sides of said web, a pair of brake shoes having a transverse web cutting blade mounted on the opposite ends of said lever arms, and the added steps of, pivoting said arms to grip said web; operating said web cutting blade in step (d) while the web is being gripped by the brake shoes; pivoting said arms to release said grip while said defective section is being diverted in step (e); pivoting said arms to regrip said web while said web is being cut and spliced in steps (f) and (g).

3. The process of claim 1 wherein said splicer has an associated member with a profile containing pulling means extending transversely across said web, and a roll of tape, said process step (g) including the step of causing said pulling means to move transversely across said web, while pulling said tape across said web, and sealing said tape across the cut and abutting ends of said upstream and downstream web.

4. A splicer for use in a corrugated cardboard production line, said splicer comprising an opposing pair of pivotally mounted levers having opposing jaw means which open and close responsive to a pivoting of said levers for enabling a passage of a web of corrugated cardboard when said jaws are opened and for gripping said web when said jaws are closed, a pair of brake shoes downstream of said jaws for holding said web while said brake shoes are closed, a blade for cutting said web between the gripping of said jaws and said brake shoes, and control means for operating said jaws, blade and brake shoes in a sequence wherein (a) said web is gripped by said jaws and held by said brake shoes, (b) said blade cuts said web, (c) said jaws open to release said grip while said brake shoes maintain said hold, (d) said jaws close to regrip said web, and (e) said blade again cuts said web a second time, and means for abutting and splicing together the cut ends of said web being held by said brake shoes and being gripped by said jaws.

5. The splicer of claim 4 and means for accumulating a store of said web prior to said cutting, said store being downstream from said splicer in said production line, and means for paying said web out of said store during said sequence whereby downstream production is not interrupted by said sequence.

6. The splicer of claim 5 and means for maintaining at least downstream web tension during said payout of said web from said store.

7. The splicer of claim 4 wherein each of the jaws has gripping means which include a pair of pads extending transversely across said web, said blade being positioned between said pads to cut said web in an area which is between said each of said pairs of pads.

8. The splicer of claim 7 and means for pulling tape across the abutting ends of said web after said second cut in step (e) of said sequence and for thereafter sealing said tape across said ends.

* * * * *